US005170736A

United States Patent [19]

Imashimizu et al.

[11] Patent Number: 5,170,736

[45] Date of Patent: Dec. 15, 1992

[54] METHOD FOR INSTALLING OUTFITTING COMPONENT ONTO MODULE FRAME

[75] Inventors: Yoshinori Imashimizu; Yoshiaki Suda, both of Kure; Etsuro Hiramoto, Hiroshima; Kunihito Morioka, Kure; Ryoichi Fujimitsu, Kure; Kazuhisa Handa, Kure, all of Japan

[73] Assignee: Ishikawajima-Harima Jukogyo Kabushiki Kaisha, Tokyo, Japan

[21] Appl. No.: 774,318

[22] Filed: Oct. 10, 1991

[30] Foreign Application Priority Data

Oct. 30, 1990 [JP] Japan ..... 2-292442
Oct. 30, 1990 [JP] Japan ..... 2-292445

[51] Int. Cl.[5] ..... A47K 4/00
[52] U.S. Cl. ..... 114/65 R; 114/71
[58] Field of Search ..... 114/65 R, 71, 355, 72, 114/77 R, 77 A, 78, 85

[56] References Cited

U.S. PATENT DOCUMENTS 3,363,597 1/1968 Zeien ..... 114/65
3,371,639 3/1968 Schillreff ..... 114/77
4,622,911 11/1986 Salminen ..... 114/71

FOREIGN PATENT DOCUMENTS 0015654 5/1979 European Pat. Off. .
988651 1/1983 U.S.S.R. ..... 114/71
2135248 8/1984 United Kingdom .
2161773 1/1986 United Kingdom .
2205281 12/1988 United Kingdom ..... 114/71

OTHER PUBLICATIONS

*Naval Engineers Journal*, vol. 83, No. 5, Oct. 1971, Washington, pp. 45–52.

*Primary Examiner*—Jesus D. Sotelo
*Assistant Examiner*—Stephen P. Avila
*Attorney, Agent, or Firm*—Oblon, Spivak, McClelland, Maier & Neustadt

[57] ABSTRACT

A module frame to form a virtual hexahedron is provided. A component and its connector are positioned and installed in the module frame by using, as a point of origin in transverse and longitudinal directions, a point on a ridge between a bow-side transverse face and a hull-center-side longitudinal face of the virtual hexahedron and using, as reference points in a vertical direction, points respectively on upper and lower faces of said virtual hexahedron. This prevents any accumulation of dimensional errors of module frames upon installation of the module frames in a ship.

2 Claims, 3 Drawing Sheets

METHOD FOR INSTALLING OUTFITTING COMPONENT ONTO MODULE FRAME

BACKGROUND OF THE INVENTION

The present invention relates to a method for installing an outfitting component onto a module frame.

In an engine room of a ship, various outfitting components such as machines, pipes, electrical cables, etc. are installed and fixed on a hull structure. Normally, a deck of the hull is built and then outfitting components are brought on or below the deck for their installation and fixing on or underneath the deck.

This conventional method has many ground and onboard operations in installation and fixing which are carried out under poor environmental conditions so that its working efficiency is low and an installation period is long. The onboard installation and fixing operations will require frequent adjustments during the operations due to size or dimensional errors, which further reduces the working efficiency.

In order to solve such problems, a module outfitting method is applied in which outfitting components are divided into a plurality of groups and a group of outfitting components is installed onto a module frame in advance in a factory or the like. An outfitted module frame is then loaded onto a ship for installation. Further outfitted module frames are loaded and connected with other outfitted module frame.

This contemplated method would drastically reduce operations done onboard and shorten a period of installation and fixing since merely the module frames manufactured outboard with outfitting components mounted thereto were brought onboard for connection.

However, the contemplated method is regarded impractical. Because, even if the above-mentioned module frames can be fabricated with a relatively high degree of accuracy in a factory or the like, dimensional errors may be accumulated depending upon how to mount outfitting components to module frames and how to position the module frames upon installation thereof onboard, which will require adjustments between the module frames and between the outfitting components. Such adjustments will require a considerable amount of time as well as much labor.

For example, particularly in the case where a straight pipe system extends over several module frames, it is conceivable that deviations in accuracy of the individual module frames and errors in fabricated dimension of straight pipes are accumulated, so that considerable gaps or interferences may appear between pipes at module joints because of short length of the pipes or long length of the pipes.

Hitherto commonly effected in such a case is use of adjustable pipes to absorb the dimensional errors, which is however disadvantageous in that a number of extra parts (adjustable pipes) are required and that an installation period may be prolonged as the result of inefficient adjusting jobs in the ship.

The present invention was made in view of the above and has its object to provide a method for installing piping components onto a module frame so as to ensure connections without adjustable pipe at a module frame joint with a high degree of accuracy and effectiveness.

Now, a preferred embodiment of the present invention will be described with reference to the accompanying drawings.

DETAILED DESCRIPTION OF PREFERRED EMBODIMENT

Figure 1:
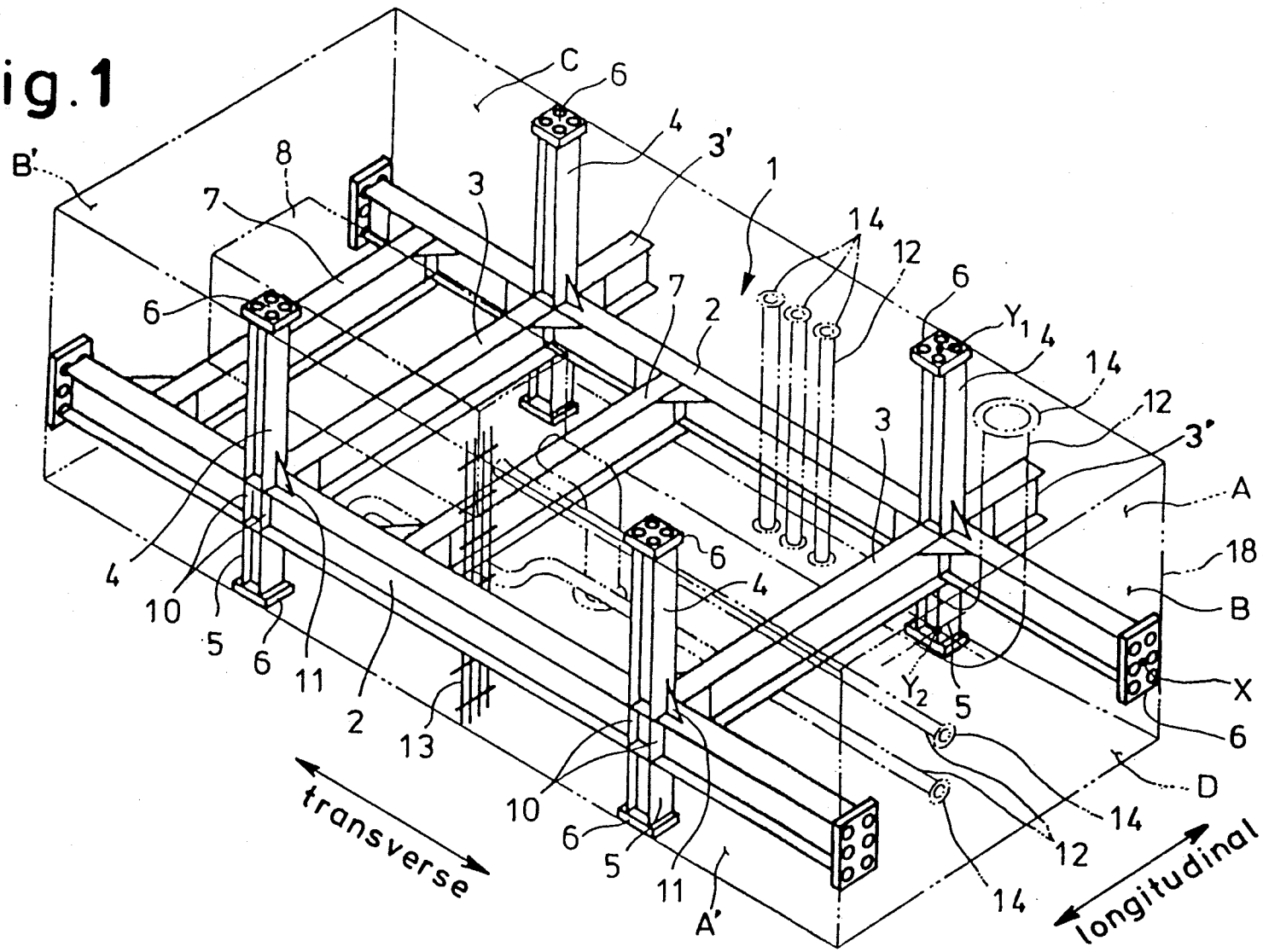
FIG. 1 is a perspective view showing a module frame to be used in a method for installing an outfitting component onto a module frame according to the present invention.

FIG. 1 shows an example of a basic shape of a module frame 1 to be used for the method according to the present invention. The module frame 1 comprises main girders 2 extending transversely and in parallel with each other, beam members 3 extending longitudinally to interconnect the main girders through welding and upper and lower support columns 4 and 5 fixed by welding to each junction of the main girders 2 with the beam members 3 and extending respectively upwardly and downwardly.

Each end of the module frame 1 has a flanged connector 6. The module frame 1 is so constructed as to provides a virtual hexahedron as a whole by outward surfaces or connection surfaces of the flanged connectors 6.

Figure 2:
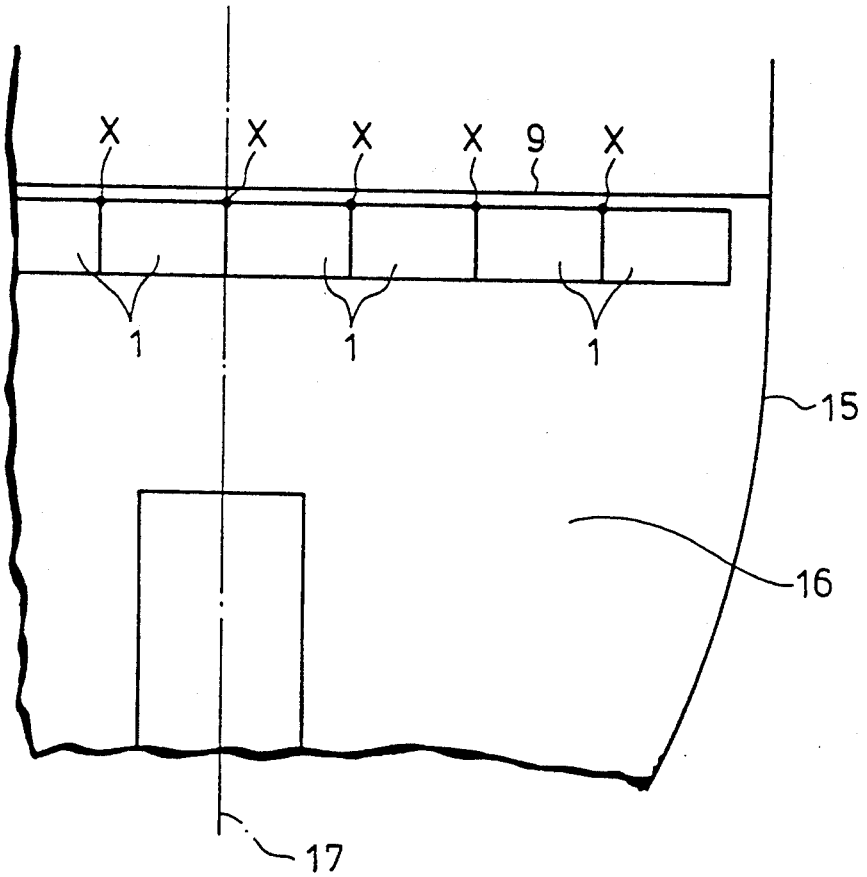
FIG. 2 is a part of plan view of an engine room of a ship illustrating the point of origin for installation of the module frames shown in FIG. 1 and in accordance with the present invention.

In FIG. 1, reference number 7 denotes auxiliary beams added to support heavy components 8; 3', extensions to retain the module frame 1 by connecting it to a hull structure 9 such as bulkhead shown in FIG. 2 after the module frame 1 has been installed in the ship; 10, reinforcing ribs; and 11, reinforcing brackets.

In addition to the components 8, the module frame 1 may be fitted with various components such as pipes 12 and electrical cables 13. Reference numeral 14 indicates connectors such as flanges on the piping 12 which are provided for connection of the piping 12.

The module frame 1 is constructed by assembling the main girders 2, the beam members 3, the upper and lower support columns 4 and 5 and so forth through welding or the like to form a frame structure. After removal of welding distortion, the individual members 2, 3, 4, and 5 are connected through welding or the like with the connectors 6 positioned with a high degree of accuracy, thereby forming a virtual hexahedron with a high degree of accuracy.

In stalling the components 8, 12, and 13 to the module frame 1, a single point (for example, a center) of one connector 6, which is positioned on a ridge 18 formed with one longitudinal face and one transversal face of the virtual hexahedron, is taken as point of origin X in the longitudinal and transverse directions to position and install the outfitting components 8, 12, and 13 and the connectors 14. The point of origin X will be selected to be located on the connector 6 which is positioned on the ridge or corner 18 between the bow-side tranverse face A and the hull-central-side longitudinal face B (see FIG. 1).

Also, among the connectors 6 for the upper support columns 4 which form an upper face C of the virtual hexahedron, one connector 6 is selected which is closest to the above-mentioned point of origin X. Similarly, one connector 6 among the connectors 6 for the lower support columns 5 which from a lower face D of the virtual hexahedron is selected which is closest to the above-mentioned point of origin X. One point (for example, the central point) on a upper surface of the selected connector 6 of the upper support column 4 and one point (for example, the central point) on a lower surface of the selected connector 6 of the lower support column 5 are respectively taken as reference points $Y_1$ for the upper surface and reference point $Y_2$ for the lower surface. Positioning of the outfitting components 8, 12 and 13 and the connector 14 in a vertical direction is carried out on the basis of these reference points $Y_1$ and $Y_2$.

As mentioned above, consistent utilization of the point of origin X in the transverse and longitudinal directions and the reference points $Y_1$ and $Y_2$ in the vertical direction will enable all of the components 8, 12 and 13 and the connector 14 to be positioned and installed with a high degree of accuracy.

Upon installation of the module frames 1 with the components 8, 12 and 13 inside an engine room 16 of a ship 15, each module frame 1 is positioned and installed one by one such that the point of origin X for each module frame 1 at the bow and hull central sides is aligned with planned installation point of the ship 15 as shown in FIG. 2 to thereby prevent accumulation of dimensional errors of the individual module frames 1.

When outfitting components such as pipes 12 and electrical cables 13 are to be installed onto the module frame 1, the electrical cables 13 which have a relatively high degree of flexibility can be readily adjusted in length and provide easy interconnection works between the module frames 1. On the other hand, the straight pipes 12, if not fabricated with a high degree of accuracy, may be either so short that a gap is formed between the flanges 14 upon interconnection of the pipes 12 between the module frames 1 or may be so long that the flanges 14 stick out of face A, A', B, B' or C D to thereby make interconnection of the pipes 12 impossible.

Figure 4:
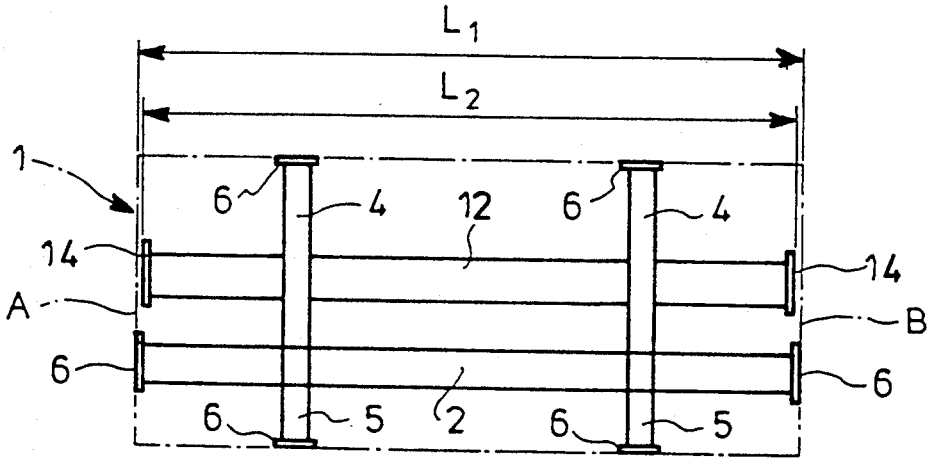
FIG. 4 is a detailed view showing one of the module frames in FIG. 3.

To solve this problem, the pipes 12 which are to be installed in the module frame 1 to stretch across the faces A and A', B and B' or C and D (see FIG. 1) forming the virtual hexahedron are fabricated with a minus margin of for example 0 to −2 mm so that their length may be equal to or less than a length (distance) between the corresponding faces. Thus, the pipes 12 which stretch across the faces A and A' are fabricated to a length $L_1$ of the virtual hexahedron or a length $L_2$ with a minus margin of for example 0 to −2 mm or slightly shorter than $L_1$ as shown in FIG. 4.

This will prevent a failure to interconnect the module frames 1.

Figure 3:
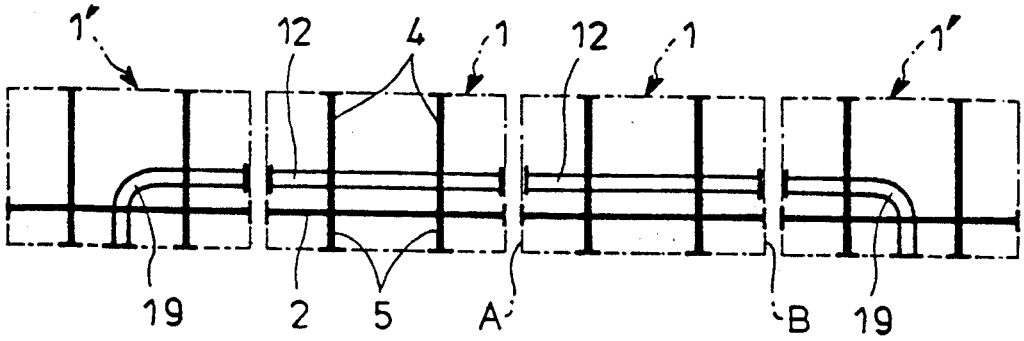
FIG. 3 is a view illustrating module frames including straight pipings to be interconnected in accordance with the method for installing an outfitting component onto a module frame of the present invention.
Figure 5:
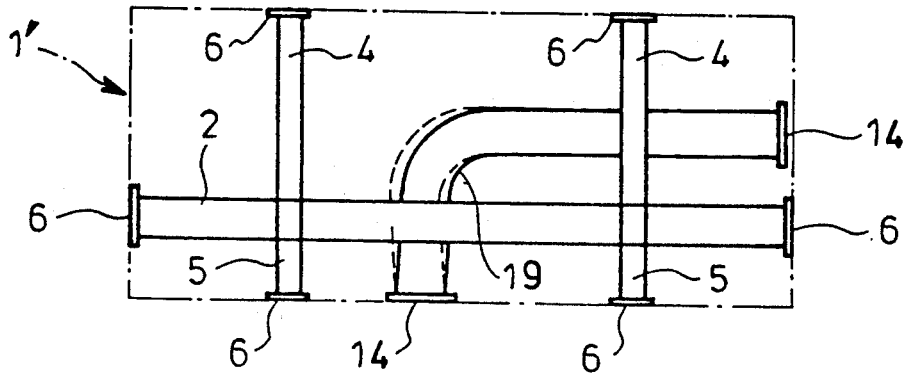
FIG. 5 is a detailed view showing another module frame in FIG. 3.

Another module frame 1' connected to the module frame 1 has a bent pipe 19 which is bent for example at 90° in relation to the axis of the pipes 12 as shown in FIGS. 3 and 5.

Providing such bent pipe 19 is advantageous in that any accumulated dimensional errors due to interconnection of the straight pipes 12 can be readily absorbed by the bent pipe 19 as shown by the solid and broken lines in FIG. 5.

As is clear from the foregoing, the method according to the present invention can completely eliminate position adjustments between the module frames and between the components 8, 12 and 13, thereby remarkably reducing the operation period in installation of the module frames in the ship. Moreover, high degree of accuracy obtained will ensure interchangeability of module frames.

It is to be understood that the method for installing an outfitting component onto a module frame according to the present invention is not limited to the above-described embodiment and may be variously modified without leaving the true spirit of the present invention. For example, when the module frame 1 has an upper plate on which components are to be installed, the point of origin X may be set on a ridge of a corner of the plate at its bow and hull-center sides.

As described above, according to the method for installing an outfitting component onto a module frame of the present invention, a position of a component onto a module frame is determined on the basis of the point of origin in the transverse and longitudinal directions and reference points in the vertical direction so that occurrence of dimensional errors in each module frame can be minimized. Positioning and installation of each module frame in a ship on the basis of the above point of origin can prevent accumulation of dimensional errors of module frames, which enables collective installation of components in the ship to thereby achieve a considerable reduction of an installation operation period.

In case where pipes are to be installed over two parallel opposing faces of a virtual hexahedron formed by a module frame, the pipes are fabricated with a minus margin, which can prevent failure in interconnection of the pipes on the module frames. Dimensional errors of the pipes and the module frames can be absorbed by bent pipes installed within module frames, so that installation operation of the module frames with the pipings in a ship can be facilitated, leading to a considerable reduction of an operation period.

What is claimed is:

1. A method for installing an outfitting component onto a module frame comprising the steps of assembling columns, main girders and beam members each having connectors at opposite ends thereof into a module frame to form a virtual hexahedron defining planes in which lie end faces of said connectors, and upon installation of said module frame to a hull, positioning and installing the component in the module frame by using, as a point of origin in transverse and longitudinal directions, a point on an end face of one of said connectors on a ridge between a transverse face, directed to a bow, and a longitudinal face, directed to a hull center, of the virtual hexahedron and using, as reference points in a vertical direction, points respectively on an end face of each connector of a selected pair of connector lying in upper and lower faces, respectively, of said virtual hexahedron.

2. The method according to claim 1 wherein a pipe to be installed in the module frame to extend between opposing faces of the virtual hexahedron is fabricated with a size slightly shorter than a distance between said faces, said pipe being connected axially and at opposite ends thereof to pipes of adjacent module frames, at least one of the pipes of said adjacent module frames having a bend therein relative to an axis of the first-mentioned pipe, whereby any dimensional errors between said pipes to be connected are compensated by bending deformation of said bend.

* * * * *